US006040097A

United States Patent [19]

Yoon et al.

[11] Patent Number: 6,040,097

[45] Date of Patent: Mar. 21, 2000

[54] SOLUTION FOR MAKING PHOTOCONDUCTIVE LAYER AND AN ELECTROPHOTOGRAPHIC MANUFACTURING METHOD OF THE LAYER IN CRT

[75] Inventors: Sang Youl Yoon, Kyungsangbuk-do; Ho Seok Shon, Seoul, both of Rep. of Korea

[73] Assignee: Orion Electric Co., Ltd., Kyungsangbuk-do, Rep. of Korea

[21] Appl. No.: 09/117,481

[22] PCT Filed: Dec. 30, 1996

[86] PCT No.: PCT/KR96/00276

§ 371 Date: Jul. 30, 1998

§ 102(e) Date: Jul. 30, 1998

[87] PCT Pub. No.: WO98/24110

PCT Pub. Date: Jun. 4, 1998

[30] Foreign Application Priority Data

Nov. 30, 1996 [KR] Rep. of Korea ..... 96-60205
Nov. 30, 1996 [KR] Rep. of Korea ..... 96-60206

[51] Int. Cl.[7] ..... G03G 5/06

[52] U.S. Cl. ..... 430/28; 430/70; 430/72

[58] Field of Search ..... 430/23, 28, 70, 430/72

[56] References Cited

U.S. PATENT DOCUMENTS 5,405,722 4/1995 Data et al. ..... 430/28
5,554,468 9/1996 Datta et al. ..... 430/28

OTHER PUBLICATIONS

Borsenberger, Paul M and David S. Weiss. Organic Photoreceptors for Imaging Systems. New York: Marcel–Dekker, Inc. pp. 416–419, 1993.

*Primary Examiner*—Christopher D. Rodee
*Attorney, Agent, or Firm*—Notaro & Michalos P.C.

[57] ABSTRACT

Disclosed is a photoconductive solution which has excellent charge characteristics with easy control of charge amount and is completely volatilized after baking. The solution contains 2 to 5% by weight of tetraphenyl ethylene as ultraviolet-sensitive material. 0.1 to 1 wt. % diphenylpicrylhydrazine or 0.1 wt. % or less of tetracyanoquinodimethane(TCNQ) as ultraviolet-sensitive donor material is desirably added to the tetraphenyl ethylene of 2 to 5 wt. % for better accomplishment of the purpose, and the solution contains at least one of trinitrofluorenone, ethylanthraquinone and their mixture of 0.1 to 1 wt. % as an acceptor. The solution is formed by mixing the above ingredients together with 10 to 20 wt. % of polystyrene-oxazoline copolymer(PS-OX) as polymer binder, and 20 to 85 wt. % of toluene as solvent.

6 Claims, 2 Drawing Sheets

SOLUTION FOR MAKING PHOTOCONDUCTIVE LAYER AND AN ELECTROPHOTOGRAPHIC MANUFACTURING METHOD OF THE LAYER IN CRT

FIELD OF THE INVENTION

The present invention relates to a solution for making a photoconductive layer and a method of electrophotographically manufacturing a viewing screen for a cathode ray tube(CRT) using the solution, and more particularly to a photoconductive solution which has higher charge characteristics by a corona discharger with a similar photoconductivity to one in the prior art.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14 and a shadow mask 16 removably mounted to a sidewall of the panel 12. A three color phosphor screen is formed on the inner surface of a display window or faceplate 18 of the panel 12.

The electron gun 11 generates three electron beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, as shown in FIG. 2, comprises an array of three phosphor elements R, G and B of three different emission colors arranged in a cyclic order of a predetermined structure of multiple-stripe or multiple-dot shape and a matrix of light-absorptive material surrounding the phosphor elements R, G and B.

A thin film of aluminum 22 overlies the screen 20 in order to provide a means for applying the uniform potential applied through the anode button 15 to the screen 20, increase the brightness of the phosphor screen and prevent from degrading ions in the phosphor screen and decreasing the potential of the phosphor screen. And also, a film of resin such as lacquer(not shown) may be applied between the aluminum thin film 22 and the phosphor screen to enhance the flatness and reflectivity of the aluminum thin film 22

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby necessitating a high cost in manufacturing the phosphor screen. And also, it discharges a large quantity of effluent such as waste water, phosphor elements, 6th chrome sensitizer, etc., with the use of a large quantity of clean water.

To solve or alleviate the above problems, the improved process of electrophotographically manufacturing the screen utilizing dry-powdered phosphor particles is developed. U.S. Pat. No. 4,921,767, issued to Datta at al. on May 1, 1990, describes one method of electrophotographically manufacturing the phosphor screen assembly using dry-powdered phosphor particles through the repetition of a series of steps represented in FIGS. 3A to 3E, as is briefly explained in the following(FIG. 3D and FIG. 3E respectively show a developing step and a fixing step described in our copending Korean patent application Serial No. 95-10420 filed on Apr. 29, 1995 and assigned to the assignee of the present invention.)

Prior to the electrophotographic screening process, foreign substance is clearly removed from an inner surface of a panel by several conventional methods. Then, a conductive layer 132, as shown in FIG. 3A, is formed by conventionally coating the inner surface of the viewing faceplate 18 with a suitable conductive solution comprising an electrically conductive material which provides an electrode for an overlying photoconductive layer 134. The conductive layer 132 can be an inorganic conductive material such as tin oxide or indium oxide, or their mixture or, preferably, a volatilizable organic conductive material consisting of a polyelectrolyte commercially known as polybrene (1,5-dimethyl-1,5-diazaundecamethylene polymethobromide, hexadimethrine bromide), available from Aldrich Chemical Co., Milwaukee Wis., or another quaternary ammonium salt. The polybrene is conventionally applied to the inner surface of the viewing faceplate 18 in an aqueous solution containing about 10 percent by weight of propanol and about 10 percent by weight of a water soluble, adhesion promoting polymer such as poly(vinyl alcohol), polyacrylic acid, certain polyamide and the like, and the coated solution is dried to form the conductive layer 132 having a thickness from about 1 to 2 microns and a surface resistivity of less than about $10^8$ ohms per square unit.

The photoconductive layer 134 is formed by coating the conductive layer 132 with a photoconductive solution comprising a volatilizable organic polymeric material, a suitable photoconductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethyl-methacrylate or polypropylene carbonate. The suitable dyes, which are sensitive to light in the visible spectrum, preferably from about 400 to 700 nm, include crystal violet, chloridine blue, rhodamine EG and the like. This dye is typically present in the photoconductive composition in from about 0.1 to 0.4% by weight. The solvent for the photoconductive composition is an organic such as chlorobenzene or cyclopentanone and the like which will produce as little cross contamination as possible between the layers 132 and 134. The photoconductive solution is conventionally applied to the conductive layer 132, as by spin coating, and dried to form a layer having a thickness from about 2 to 6 microns.

FIG. 3B schematically illustrates a charging step, wherein the photoconductive layer 134 overlying the conductive layer 132 is positively charged in a dark environment by a conventional positive corona discharger 136, which moves across -the layer 134 and charges it within the range of +200 to +700 volts.

FIG. 3C schematically shows an exposure step, wherein the shadow mask 16 is inserted in the panel 12 and the charged photoconductor is exposed through a lens system 140 and the shadow mask 16, to the light from a xenon flash lamp 138 disposed at one position within a conventional three-in-one lighthouse. Then, the positive charges of the exposed areas are discharged through the grounded conductive layer 132 and the charges of the unexposed areas remain in the photoconductive layer 134, thus establishing a latent charge image in a predetermined array structure. Three exposures are required for forming a light-absorptive matrix with three different incident angles, respectively.

FIG. 3D diagrammatically illustrates the outline of a developing step, as described in the Korean patent application Serial No. 95-10420 cited above. In FIG. 3D, after removing the shadow mask 16, suitably charged, dry-powdered particles such as particular color-emitting phosphor particles or light-absorptive material particles are sprayed by compressed air toward a photoconductive layer 134 through a venturi tube 146 and a nozzle 144*b* from a hopper 148 and attracted to one of the charged or unexposed areas and the discharged or exposed areas depending upon the polarity of the charged particles due to electrical attraction or repulsion, thus one of the two areas is developed in a predetermined array pattern. Below the nozzle 144*b*, there is provided a discharge electrode 144*a* such as a corona discharger for charging dry-powdered particles to be sprayed in the nozzle 144*b*. The light-absorptive material particles for directly developing the unexposed or positively charged areas are negatively charged and the phosphor particles are positively charged for reversely developing the exposed or discharged areas. The charging of the dry-powdered particles may be executed by a triboelectrical charging method using surface-treated carrier beads, as disclosed in U.S. Pat. No. 4,921,767 cited above.

FIG. 3E schematically illustrates a fixing step using a vapor swelling method, as described in the Korean patent application serial No. 95-10420 cited above.

In the fixing step, the surface of polymers contained in the photoconductive layer 134 are dissolved by coming into contact with solvent vapor such as acetone, methyl isobutyl ketone, etc., on the surface of the developed photoconductive layer 134, said dissolved polymers fixing the dry-powdered particles deposited on the developed areas of the photoconductive layer 134.

The fixing step also may be executed by infrared radiation to fix the deposited particles by melting or thermally bonding the polymer components of the particles 21 and the photoconductive layer 134 to the photoconductive layer 134, as disclosed in U.S. Pat. No. 4,921,767 cited above.

The steps of charging, exposing, developing and fixing are repeated for the black matrix particles and the three different phosphor particles. The faceplate panel 12 is baked in air at a temperature of 425 degrees centigrade, for about 30 minutes to drive off the volatilizable constituents of screen including the conductive layer 132, the photoconductive layer 134, the solvents present in both the screen structure materials and in the filming lacquer, thereby forming an screen array of light-absorptive material 21 and three phosphor elements R, G and B in FIG. 2.

The aforementioned process, as disclosed in U.S. Pat. No. 4,921,767 cited above, has one problem that it requires dark environment during performing all the steps since the photoconductive layer is sensitive to the visual light.

Korean patent application serial No. 95-10420, cited above, and U.S. Pat. No. 5,413,885 disclose a method of electrophotographically manufacturing the CRT screen under visible lights or low intensity yellow lights of 577–597 nm using a novel photoconductive layer to solve the aforementioned problem. The photoconductive layer is formed by applying a photoconductive solution containing bis dimethyl phenyl diphenyl butatriene as a donor of ultraviolet-sensitive material, and one of trinitro fluorenone (TNF), ethylanthraquinone (EAQ) and their mixture as an acceptor with polystyrene as polymer binder.

The photoconductive solution, which, as described in FIG. 3A, contains the organic polymer or an organic monomer such as n-ethyl carbazole, n-vinyl carbazole or tetraphenylbutatriene dissolved in a polymeric binder such as polymethyl-methacrylate or polypropylene carbonate, and the suitable dyes sensitive to light, or which contains bis dimethyl phenyl diphenyl butatriene and one of trinitro fluorenone(TNF), ethylanthraquinone(EAQ) and their mixture with polystyrene, is applied to the conductive layer 132, thereby the photoconductive layer 134 being formed.

However, since said photoconductive layer 134 has low charge characteristics and the applied potential is limited in order to prevent the damage of the photoconductive layer 134, there are some problems that it takes much time to charge the photoconductive layer 134 with the corona discharger 144*a* in FIG. 3B and the whole surface of the photoconductive layer 134 is not charged uniformly. Also, further problem is that said bis-1,4-dimethyl phenyl(-1,4-diphenyl(butatriene)) is not volatilized perfectly after burning in the frit step of bulb and 8 or 10wt. % thereof remains on the screen structure of the panel.

In order to remove the aforementioned problems, it is an object of the present invention to provide a photoconductive solution which has excellent charge characteristics with easy control of charge amount and is completely volatilized after baking.

SUMMARY OF THE INVENTION

To accomplish the aforementioned purpose, the present invention provides a solution for forming a photoconductive layer for electrophotographically manufacturing a luminescent screen on an interior surface of a faceplate panel for a CRT comprising the steps of coating said surface of the panel with a volatilizable conductive layer and an overlying volatilizable photoconductive layer, establishing a substantially uniform electrostatic charge over the whole area of the inner surface of said photoconductive layer, exposing selected areas of said photoconductive layer to discharge the charge from the selected areas, developing one of the charged, unexposed areas and the discharged, exposed areas depending upon the polarity of the charged particles with one of charged phosphor particles and light-absorptive material particles, said solution containing 2 to 5% by weight of tetraphenyl ethylene as ultraviolet-sensitive material.

In said solution, 0.1 to 1 wt. % diphenylpicryl-hydrazine (DPPH) is desirably added to said tetraphenyl ethylene of 2 to 5 wt. % for better accomplishment of the purpose, and the solution may contain at least one of trinitrofluorenone(TNF), ethyl-anthraquinone(EAQ) and their mixture by 0.1 to 1 wt. % respectively as an acceptor.

Said solution is formed by mixing the above ingredients together with 10 to 20 wt. % of polystyrene-oxazoline copolymer(PS-OX) as polymer binder, and 20 to 85 wt. % of toluene as solvent.

The present invention further provides a solution for forming a photoconductive layer for, and a method of, electrophoto-graphically manufacturing a luminescent screen on an interior surface of a faceplate panel for a CRT comprising the steps of coating said surface of the panel with a volatilizable conductive layer and an overlying volatilizable photoconductive layer, establishing a substantially uniform electrostatic charge over the whole area of the inner surface of said photoconductive layer, exposing selected areas of said photoconductive layer to discharge the charge from the selected areas, developing one of the charged, unexposed areas and the discharged, exposed areas depending upon the polarity of the charged particles with one of charged phosphor particles and light-absorptive material particles, said solution comprising 2 to 5% by weight of tetraphenyl ethylene, diphenylpicryl-hydrazine(DPPH) of 0.1 to 1 wt. % as a donor, at least one of 0.1 to 1 wt. % of trinitro-fluorenone(TNF), 0.1 to 1 wt. % of ethylanthraquinone(EAQ) and 0.1 to 1 wt. % of their mixture as an acceptor, 10 to 20 wt. % of polystyrene-oxazoline copolymer(PS-OX) as polymer binder, and 20 to 85 wt. % of toluene as solvent.

In the foregoing solution and method, said overlying volatilizable photoconductive layer can be formed by applying a solution comprising 2 to 5% by weight of tetraphenyl ethylene and 0.1 wt. % or less of tetracyanoquino-dimethane (TCNQ) as ultraviolet-sensitive donor material. In this case, as an acceptor, at least one of 0.1 to 1 wt. % of trinitrofluorenone(TNF), 0.1 to 1 wt. % of ethylanthraquinone(EAQ) and 0.1 to 1 wt. % of their mixture and 10 to 20 wt. % of polystyrene-oxazoline copolymer (PS-OX) as polymer binder are comprised, and 20 to 85 wt. % of toluene is used as solvent.

DETAILED DESCRIPTION OF THE PREFERRED EMBODIMENT

Figure 1:
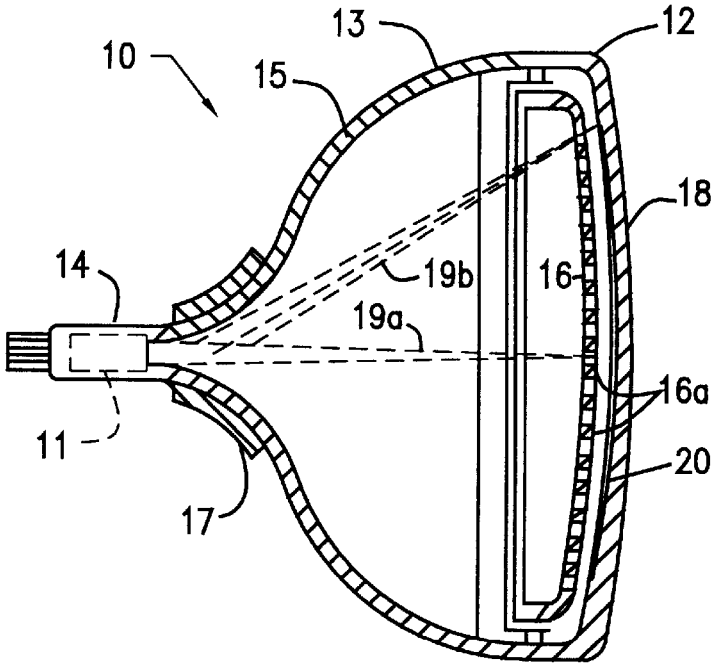
FIG. 1 is a plan view partially in axial section of a color cathode-ray tube.

As described above relating to FIG. 3A, the interior surface of a panel 18 is coated with a volatilizable conductive layer 132 and an overlying volatilizable photoconductive layer 134. Said photoconductive layer 134 is formed by applying a photoconductive solution to the conductive layer 132.

According to one embodiment of the present invention, said solution is prepared by dissolving 2 to 5% by weight of tetraphenyl ethylene as ultraviolet-sensitive donor material, at least one of. 0.1 to 1 wt. % of trinitrofluorenone (TNF), 0.1 to 1 wt. % of ethylanthraquinone (EAQ) and 0.1 to 1 wt. % of their mixture as an acceptor, and 10 to 20 wt. % of polystyrene-oxazoline copolymer(PS-OX), in 20 to 85 wt. %(balance) of toluene as solvent.

According to another embodiment of present invention, a photoconductive solution comprises 2 to 5% by weight of at least one of tetraphenyl ethylene and 0.1 wt. % or less of tetracyanoquinodimethane(TCNQ) as a donor, at least one of 0.1 to 1 wt. % of trinitrofluorenone(TNF), 0.1 to 1 wt. % of ethylanthraquinone(EAQ) and 0.1 to 1 wt. % of their mixture as an acceptor, 10 to 20 wt. % of polystyrene-oxazoline copolymer(PS-OX), and 20 to 85 wt. % of toluene as solvent. Such solution is applied to the conductive layer 132 by the conventional method, thereby forming the photoconductive layer 134.

Said tetraphenyl ethylene acts as a donor and said trinitrofluorenone(TNF) or ethylanthraquinone (EAQ) acts as an acceptor when exposed to ultraviolet rays. Such solution is applied to the conductive layer 132 by the conventional method, thereby forming the photoconductive layer 134.

Figures 3A, 3B, 3C, 3D, 3E:
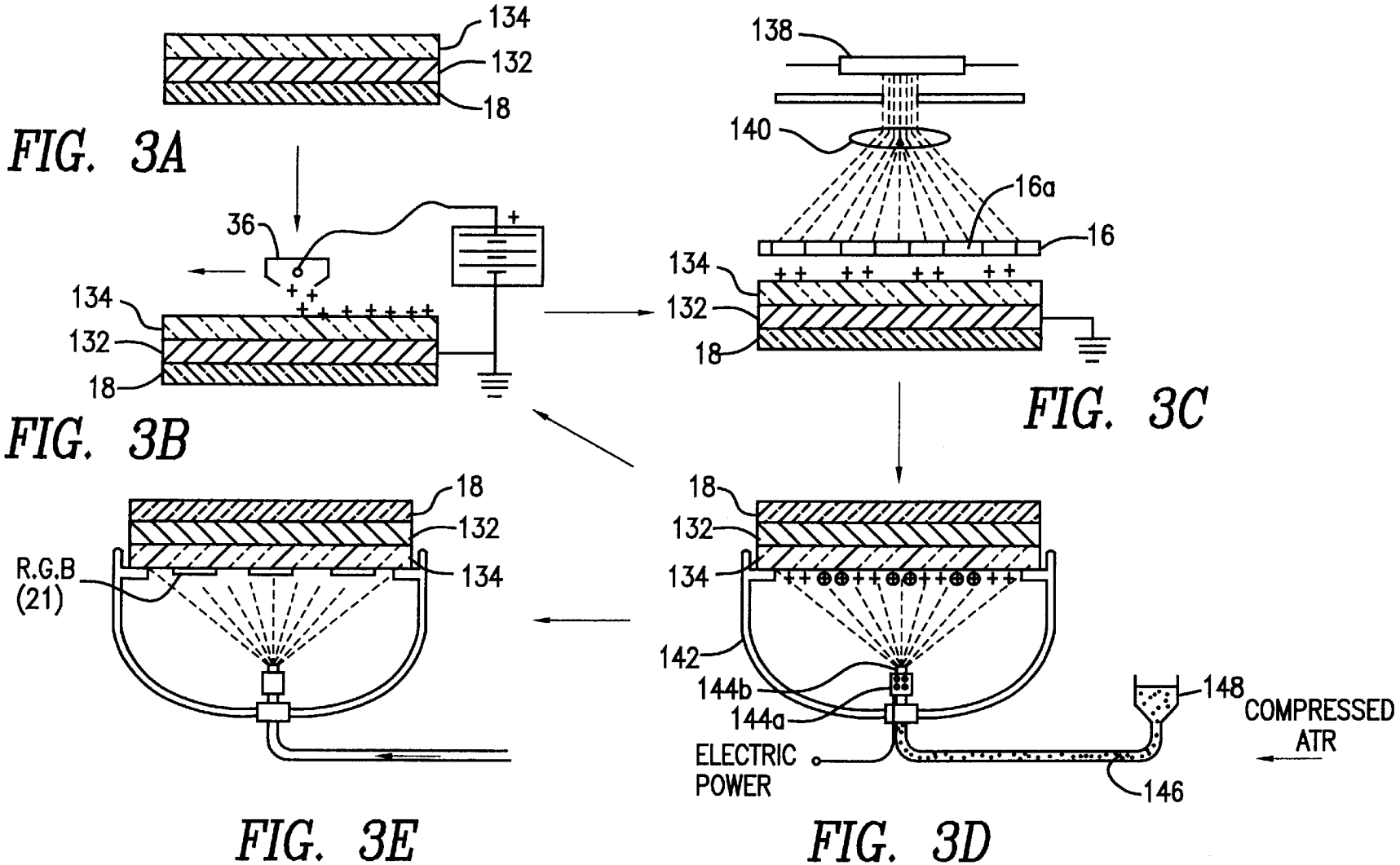
FIGS. 3A through 3E show various steps in electrophotographically manufacturing the screen assembly of the tube by viewing a portion of a faceplate having a conductive layer and an overlying photoconductive layer.

Thus, the photoconductive layer 134 formed by applying the solution is shown to have excellent charge or electric characteristics in the charging step of FIG. 3B and is almost volatilized after performing a series of the exposing step (FIG. 3C), the developing step(FIG. 3D), the fixing step (FIG. 3E) and the baking step(not shown). That is, although, in the case of the prior bis dimethyl phenyl diphenyl butatriene, the charge voltage or breakdown voltage is 140 volts per 1 micron of its thickness and the residual potential 20 volts, they are shown to be around 160 volts per 1 micron of its thickness and around 40 volts in the case of the tetraphenyl ethylene according to the present invention. Particularly, when diphenylpicrylhydrazine(DPPH) of 0.1 to 1 wt. % or 0.1 wt. % or less of tetracyanoquino-dimethane (TCNQ) as ultraviolet-sensitive donor material is added to the tetraphenyl ethylene, the photoconductive layer 134 is show to have far more excellent charge or electric characteristics.

Also, the tetraphenyl ethylene according to the present invention is perfectly burned and volatilized without any residual substance at 400 degrees centigrade.

In the foregoing embodiments, in the case of containing below 2 wt. % of tetraphenyl ethylene, the photoconductive layer does not act as the ultraviolet-sensitive layer, and in the case of over 5 wt. % of the tetraphenyl ethylene, foreign substance undesirably comes into existence and is coagulated or bubble is generated on the photoconductive layer.

The aforementioned solutions according to the aforementioned embodiments of the present invention are used in electrophotographically manufacturing a luminescent screen on an interior surface of a faceplate panel for a CRT as described in the following.

In FIG. 3A, the inner surface of a panel 18 is coated with a volatilizable conductive layer 132 as described in the forgoing prior art and then with an overlying volatilizable photoconductive layer 134 using any one of the forgoing solutions of the present invention. The photoconductive layer 134 is uniformly and quickly charged with positive electrostatic charge over the whole area of the inner surface thereof by the corona discharger 144*a* and then, said photoconductive layer is exposed in selected areas thereof to discharge the charge from the selected areas, developing one of the charged, unexposed areas and the discharged. The exposed areas are developed with charged phosphor particles and said developed phosphor particles are fixed on the photoconductive layer 134, such steps being performed under the visual light.

Figure 2:
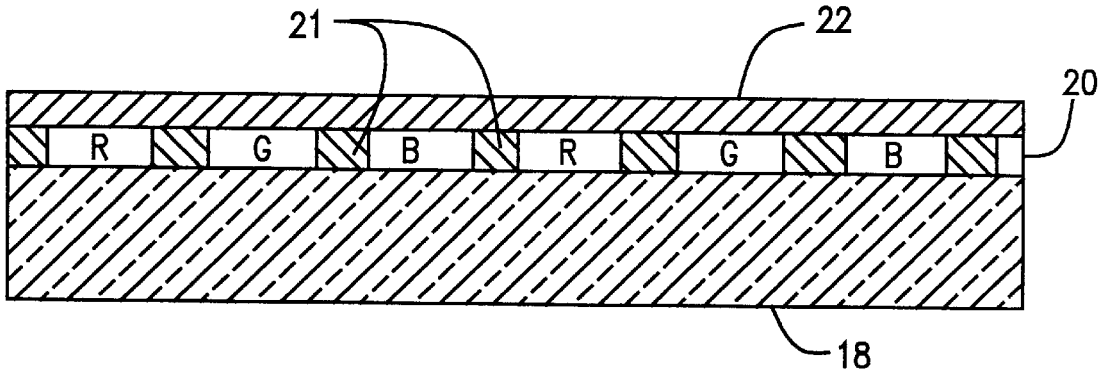
FIG. 2 is an enlarged section of a screen assembly of the tube shown in FIG. 1.

The steps of charging, exposing, developing and fixing are repeated for the black matrix particles and the three different phosphor particles. After the screen is formed using said photoconductive solution by the method as described in relation to FIGS. 3A to 3E, a spray film of lacquer and an overlying aluminum thin film are formed on the screen as is known in the art. The screen is baked at a high temperature, as is known in the art and then the volatilizable constituents of the screen including the conductive layer 132, the photoconductive layer 134, etc., are completely driven off, thus the screen being formed with the light-absorptive black matrix 21 and an array of the three different phosphor elements R, G and B and without any other foreign substance as illustrated in FIG. 2.

The aforementioned solutions of the present invention facilitate controlling of charge in the charging step of FIG. 3B, and develop the charge characteristics of the photoconductive layer with maintaining the charge in the photoconductive layer for a long time. Also, said solutions can be completely removed from the screen, thus improving the quality of the CRT's screen.

It should be clear to one skilled in the art that the present solutions can be altered and applied without any limitation to the aforementioned embodiments of the present invention and within the scope of the present invention's spirit. For example, the present solution can be used for electrophotographically manufacturing the screen by the method as described in U.S. Pat. No. 4,921,767, cited above.

What is claimed is:

1. A solution for forming a photoconductive layer for electrophotographically manufacturing a luminescent screen on an interior surface of a faceplate panel for a CRT created by coating the interior surface of the faceplate panel with a volatilizable conductive layer and an overlying volatilizable photoconductive layer, establishing a substantially uniform electrostatic charge over the whole area of the inner surface of the photoconductive layer, exposing selected areas of the of the photoconductive layer to discharge the charge from the selected areas, developing one of the charged, unexposed areas and the discharged, exposed areas with one of charged phosphor particles and light-absorptive material particles, depending upon the polarity of the charged particles, the solution comprising:

2–5% by weight of tetraphenyl ethylene as an ultraviolet-sensitive donor material; and 0.1–1% by weight of diphenylpicrylhydrazine.

2. A solution according to claim 1, further comprising 0.1–1% by weight of an acceptor selected from the group consisting of trinitrofluorenone (TNF), ethylanthraquinone (EAQ), and mixtures thereof.

3. A solution according to claim 2, further comprising 10–20% by weight of polystyrene-oxazoline copolymer (PS-OX) as a polymer binder and 20–85% by weight of toluene as a solvent.

4. A solution for forming a photoconductive layer for electrophotographically manufacturing a luminescent screen on an interior surface of a faceplate panel for a CRT created by coating the interior surface of the faceplate panel with a volatilizable conductive layer and an overlying volatilizable photoconductive layer, establishing a substantially uniform electrostatic charge over the whole area of an inner surface of the photoconductive layer, exposing selected areas of the photoconductive layer to discharge the charge from the selected areas, developing one of the charged, unexposed areas and the discharged, exposed areas with one of charged phosphor particles and light-absorptive material particles, depending upon the polarity of the charged particles, the solution comprising:

2–5% by weight of tetraphenyl ethylene and 0–0.1% by weight of tetracyanoquino-dimethane (TCNQ) as an ultraviolet-sensitive donor material;

0.1–1.0% by weight of an acceptor selected from the group consisting of trinitrofluorenone (TNF), ethylanthraquinone (EAQ), and mixtures thereof;

10–20% by weight of polystyrene-oxazoline copolymer (PS-OX)as a polymer binder; and 20–85% by weight of toluene as a solvent.

5. A method of electrophotographically manufacturing a luminescent screen on an interior surface of a faceplate panel for a CRT, the method comprising:

coating the interior surface of the faceplate panel with a volatilizable conductive layer and an overlying volatilizable photoconductive layer, the overlying volatilizable photoconductive layer being formed by applying and drying a solution having 2–5% by weight of tetraphenyl ethylene and 0–0.1% by weight of diphenylpicryl-hydrazine as a donor material, 0.1–1.0% by weight of an acceptor selected from the group consisting of trinitrofluorenone (TNF), ethylanthraquinone (EAQ), and mixtures thereof, 10–20% by weight of polystyrene-oxazoline copolymer (PS-OX)as a polymer binder, and 20–85% by weight of toluene as a solvent;

establishing a substantially uniform electrostatic charge over the whole area of the inner surface of the photoconductive layer;

exposing selected areas of the of the photoconductive layer to discharge the charge from the selected areas; and developing one of the charged, unexposed areas and the discharged, exposed areas with one of charged phosphor particles and light-absorptive material particles, depending upon the polarity of the charged particles.

6. A method of electrophotographically manufacturing a luminescent screen on an interior surface of a faceplate panel for a CRT, the method comprising:

coating the interior surface of the faceplate panel with a volatilizable conductive layer and an overlying volatilizable photoconductive layer, the overlying volatilizable photoconductive layer being formed by applying and drying a solution having 2–5% by weight of tetraphenyl ethylene and 0–0.1% by weight of tetracyanoquino-dimethane (TCNQ) as an ultraviolet-sensitive donor material, 0.1–1.0% by weight of an acceptor selected from the group consisting of trinitrofluorenone (TNF), ethylanthraquinone (EAQ), and mixtures thereof, 10–20% by weight of polystyrene-oxazoline copolymer (PS-OX)as a polymer binder, and 20–85% by weight of toluene as a solvent;

establishing a substantially uniform electrostatic charge over the whole area of the inner surface of the photoconductive layer;

exposing selected areas of the of the photoconductive layer to discharge the charge from the selected areas; and developing one of the charged, unexposed areas and the discharged, exposed areas with one of charged phosphor particles and light-absorptive material particles, depending upon the polarity of the charged particles.

* * * * *